US008264449B2

(12) United States Patent
Liao et al.

(10) Patent No.: US 8,264,449 B2
(45) Date of Patent: Sep. 11, 2012

(54) METHOD FOR DRIVING A COLOR-SEQUENTIAL DISPLAY

(75) Inventors: Jhen-Shen Liao, Taoyuan County (TW); Kuan-Hung Liu, Taipei Hsien (TW); Yi-Nan Chu, Changhua County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 891 days.

(21) Appl. No.: 12/365,496

(22) Filed: Feb. 4, 2009

(65) Prior Publication Data

US 2009/0231263 A1 Sep. 17, 2009

(30) Foreign Application Priority Data

Mar. 14, 2008 (TW) ..... 97109140 A

(51) Int. Cl.
*G09G 3/36* (2006.01)
*G09G 5/10* (2006.01)

(52) U.S. Cl. ..... 345/102; 345/88; 345/690

(58) Field of Classification Search ..... None
See application file for complete search history.

(56) References Cited

U.S. PATENT DOCUMENTS

| | | | | |
|---|---|---|---|---|
| 2008/0224973 | A1* | 9/2008 | Louwsma | 345/88 |
| 2009/0102864 | A1* | 4/2009 | Fan-Chiang et al. | 345/690 |
| 2009/0135205 | A1* | 5/2009 | Wu et al. | 345/690 |

FOREIGN PATENT DOCUMENTS

| | | |
|---|---|---|
| JP | 2002318564 | 10/2002 |
| JP | 2003284088 | 10/2003 |
| JP | 2005070421 | 3/2005 |

* cited by examiner

*Primary Examiner* — Andrew L Sniezek
(74) *Attorney, Agent, or Firm* — J.C. Patents

(57) ABSTRACT

A method for driving a color-sequential display suitable to reduce the color break-up phenomenon of the color-sequential display is disclosed. The method includes: dividing each sub-frame period into a data-writing period and a backlight turned-on period; within the data-writing period, transmitting a data of first color; during a first duration of the backlight turned-on period, turning on a first color backlight; during a second duration of the backlight turned-on period, turning on a second color backlight.

12 Claims, 4 Drawing Sheets

METHOD FOR DRIVING A COLOR-SEQUENTIAL DISPLAY

CROSS-REFERENCE TO RELATED APPLICATION

This application claims the priority benefit of Taiwan application serial no. 97109140, filed Mar. 14, 2008. The entirety of the above-mentioned patent application is hereby incorporated by reference herein and made a part of this specification.

BACKGROUND OF THE INVENTION

1. Field of the Invention

The present invention generally relates to a color-sequential display, and more particularly, to a method for driving a color-sequential display suitable to reduce color break-up phenomenon.

2. Description of Related Art

Along with the developments of photoelectric and semiconductor technologies, the flat display industry has had flourishing progresses. Among numerous flat displays, liquid crystal display (LCD) has played a major role in the mainstream display market due to advantages of high space-utilization, low power consumption, no radiation and low electromagnetic interference thereof. An LCD usually includes an LCD panel and a backlight module. Since an LCD panel itself has no illuminant function, a backlight module needs to be disposed to provide a light source required by the LCD panel, which further enables the LCD panel to display.

A conventional backlight module of an LCD provides white light only. A set of color filters is disposed at the position of each pixel, so that the white backlight can make each pixel display different colors. In general, three color filters composing red color one (R), green color one (G) and blue color one (B) are disposed at the position of each pixel. The said technology by using color filters not only requires high cost and has low optical transmittance with each pixel where a specific color light is obtained after the color filters filter the white light emitted by the white backlight, but also has a color-blending problem. The color-blending occurs at the boundaries between the three color filters. Also a conventional solution that black matrixes are disposed at the boundaries to separate the three color filters can reduce the color-blending problem, but it brings a lower optical transmittance of the color filters.

As a state of art LCD design, the LCD is a color-filter-less one by design. The display technology herein is changed to sequentially display red color, green color and blue color within a frame period as the substitute of the prior art where the red, green and blue colors are simultaneously displayed. In association with the said color sequential method, in terms of the LCD panel structure, a regular backlight source is substituted by a light-emitting diode backlight source (LED backlight source) to facilitate a color-blending in time domain (a color-blending effect produced by quickly switching three color images, i.e. R image, G image and B image on time domain, within the duration of persistence of human eye's vision). The said technology does not need color filters; therefore, it promotes the optical transmittance of each pixel displaying.

Although the above-described technology is able to increase aperture ratio and the display brightness, but it likely causes color break-up with a dynamic image due to the limitation of persistence of human eye's vision. FIG. 1 is a diagram showing a color break-up occurs with a conventional display panel where a white block object on a frame moves rightward. Referring to FIG. 1, while a white block object is moving, the edges thereof display dark blue color, light blue color, yellow color, red color, etc., all of which are not the required white color. Obviously, such a display effect is not desired by a user.

SUMMARY OF THE INVENTION

Accordingly, the present invention is directed to a method for driving a color-sequential display suitable to reduce color break-up of the color-sequential display.

The present invention provides a method for driving a color-sequential display. The method includes: dividing each sub-frame period into a data-writing period and a backlight turned-on period; transmitting a data of a first color within the data-writing period; turning on a first color backlight during a first duration of the backlight turned-on period; and turning on a second color backlight during a second duration of the backlight turned-on period.

According to the method for driving a color-sequential display provided by an embodiment of the present invention, a frame period comprises three sub-frame periods. Within the data-writing period of a first sub-frame period, a data of red color is transmitted; during the second duration of the backlight turned-on period, a white backlight is turned on; during the first duration of the backlight turned-on period, a red backlight is turned on, wherein the second duration is prior to the first duration in the first sub-frame period. Then, within the data-writing period of a second sub-frame period, a data of green color is transmitted; during the second duration of the backlight turned-on period, the white backlight is turned on; during the first duration of the backlight turned-on period, a green backlight is turned on, wherein the second duration is arranged at the middle of the first duration in the second sub-frame period. Further, within the data-writing period of a third sub-frame period, a data of blue color is transmitted; during the second duration of the backlight turned-on period, the white backlight is turned on; and during the first duration of the backlight turned-on period, a blue backlight is turned on, wherein the second duration is after the first duration in the third sub-frame period.

According to the method for driving a color-sequential display provided by an embodiment of the present invention, a frame period comprises three sub-frame periods. Within the data-writing period of a first sub-frame period, a data of red color is transmitted; during the second duration of the backlight turned-on period, a green backlight and a red backlight are turned on; during a third duration of the backlight turned-on period, a blue backlight and the red backlight are turned on; and during the first duration of the backlight turned-on period, the red backlight is turned on, wherein the second duration is prior to both the first duration and the third duration and the third duration is prior to the first duration in the first sub-frame period. Then, within the data-writing period of a second sub-frame period, a data of green color is transmitted; during the second duration of the backlight turned-on period, the green backlight and the blue backlight are turned on; during a third duration of the backlight turned-on period, the red backlight and the green backlight are turned on, and during the first duration of the backlight turned-on period, the green backlight is turned on, wherein the second duration is prior to both the first duration and the third duration and the third duration is after the first duration in the second sub-frame period. Further, within the data-writing period of a third sub-frame period, a data of blue color is transmitted; during the second duration of the backlight turned-on period, the green backlight and the blue backlight are turned on; during a third duration of the backlight turned-on period, the blue backlight and the red backlight are turned on; during the first duration of the backlight turned-on period, the blue backlight is turned on, wherein both the second duration and the third duration are after the first duration and the third duration is after the second duration in the third sub-frame period.

According to the method for driving a color-sequential display provided by an embodiment of the present invention, a frame period comprises three sub-frame periods. Within the data-writing period of a first sub-frame period, a data of red color is transmitted; during the second duration of the backlight turned-on period, a red backlight, a green backlight and a blue backlight are turned on; and during the first duration of the backlight turned-on period, the red backlight is turned on, wherein the second duration is prior to the first duration in the first sub-frame period. Then, within the data-writing period of a second sub-frame period, a data of green color is transmitted; during the second duration of the backlight turned-on period, the red backlight, the green backlight and the blue backlight are turned on; and during the first duration of the backlight turned-on period, the green backlight is turned on, wherein the second duration is arranged at the middle of the first duration in the second sub-frame period. Further, within the data-writing period of a third sub-frame period, a data of blue color is transmitted; during the second duration of the backlight turned-on period, the red backlight, the green backlight and the blue backlight are turned on; and during the first duration of the backlight turned-on period, the blue backlight is turned on, wherein the second duration is after the first duration in the third sub-frame period.

According to the method for driving a color-sequential display provided by an embodiment of the present invention, a frame period comprises three sub-frame periods. Within the data-writing period of a first sub-frame period, a data of red color is transmitted; during the second duration of the backlight turned-on period, a white backlight is turned on; and during the first duration of the backlight turned-on period, a red backlight is turned on, wherein the second duration and the first duration are overlapped by each other in the first sub-frame period. Then, within the data-writing period of a second sub-frame period, a data of green color is transmitted; during the second duration of the backlight turned-on period, the white backlight is turned on; and during the first duration of the backlight turned-on period, a green backlight is turned on, wherein the second duration and the first duration are overlapped by each other in the first sub-frame period. Further, within the data-writing period of a third sub-frame period, a data of blue color is transmitted; during the second duration of the backlight turned-on period, the white backlight is turned on; and during the first duration of the backlight turned-on period, a blue backlight is turned on, wherein the second duration and the first duration are overlapped by each other and the brightness of the white backlight is respectively smaller than the red backlight, the green backlight and the blue backlight in the first sub-frame period.

Since during keeping a backlight in a color corresponding to the color of the displayed data turned on, a plurality of other backlight in different colors from the color of the displayed data is turned on to add different colors; therefore, the present invention can reduce the color break-up phenomenon with dynamic images.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
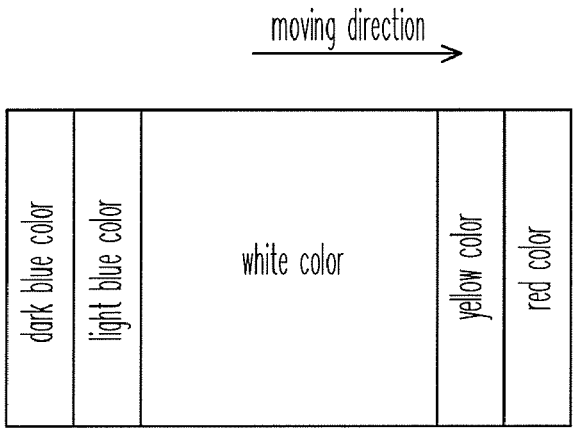
FIG. 1 (PRIOR ART)
FIG. 1 is a diagram showing a color break-up occurs with a conventional display panel where a white block object on a frame moves rightward.

Reference will now be made in detail to the present preferred embodiments of the invention, examples of which are illustrated in the accompanying drawings. Wherever possible, the same reference numbers are used in the drawings and the description to refer to the same or like parts.

Figure 2:
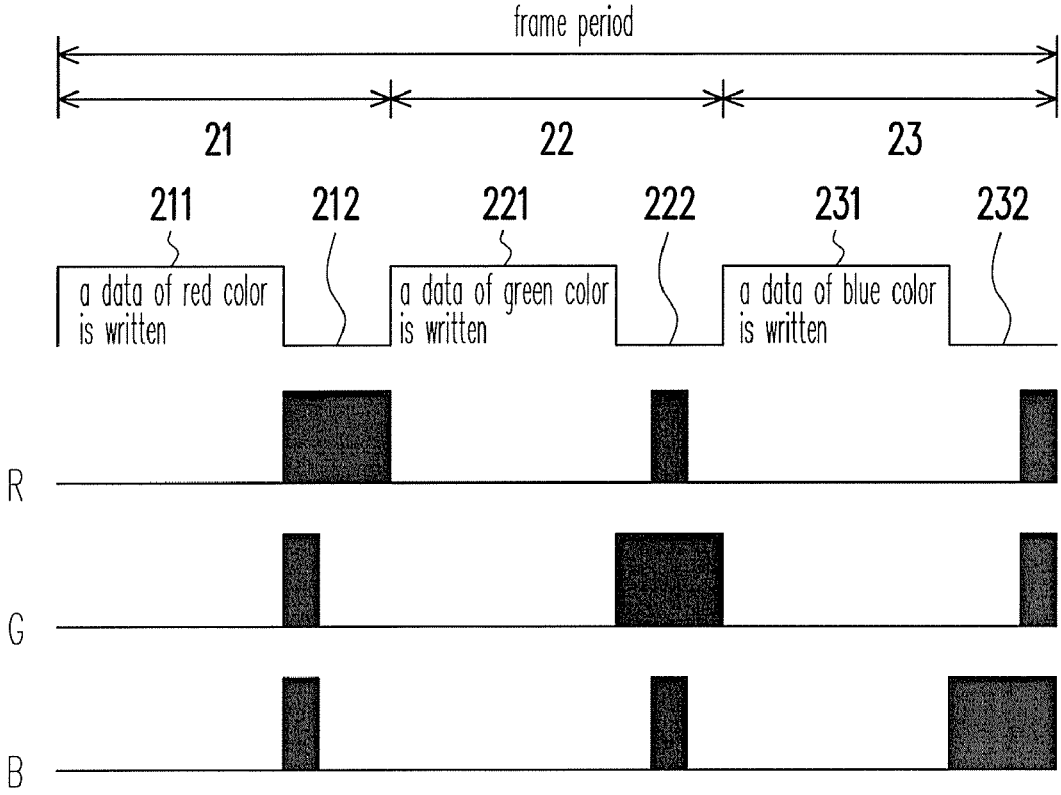
FIG. 2 is a timing diagram of the method for driving a color-sequential display according to the first embodiment of the present invention.

FIG. 2 is a timing diagram of the method for driving a color-sequential display according to the first embodiment of the present invention. Referring to FIG. 2, the first embodiment exemplarily targets an application of an LCD panel adopting the color sequential method. As shown in FIG. 2, a frame period is divided into three sub-frame periods, and each sub-frame period respectively deals with data of the red color (R), the green color (G) and the blue color (B) and backlights. Further, as shown in FIG. 2, each of the sub-frame periods 21, 22 and 23 is divided into a data-writing period 211, 221 or 231 and a backlight turned-on period 212, 222 or 232. Within the data-writing period 211 of the first sub-frame period 21, a data of red color is transmitted to each pixel by a source driver. Within the backlight turned-on period 212 of the first sub-frame period 21, a red backlight, a green backlight and a blue backlight are turned on for a predetermined time length; then, only the red backlight keeps turned on and the green backlight and the blue backlight are turned off.

Similarly, within the data-writing period 221 of the second sub-frame period 22, a data of green color is transmitted to each pixel by the source driver. Within the backlight turned-on period 222 of the second sub-frame period 22, the green backlight is turned on first; then, the red backlight and the blue backlight are turned on during a predetermined time length at the middle of backlight turned-on period 222; after that, the green backlight keeps turned on and the red backlight and the blue backlight are turned off Further, within the data-writing period 231 of the third sub-frame period 23, a data of blue color is transmitted to each pixel by the source driver. Within the backlight turned-on period 232 of the third sub-frame period 23, the blue backlight is turned on first; then, the red backlight and the green backlight are turned on during a final predetermined time length.

Since the red backlight, the green backlight and the blue backlight are simultaneously turned on according to the above-described embodiment, which is equivalent to that a white light is added during displaying a data in a specific color (R, G or B); therefore, the innovative technology can reduce the color break-up phenomenon likely occurring in the prior art.

Figure 3:
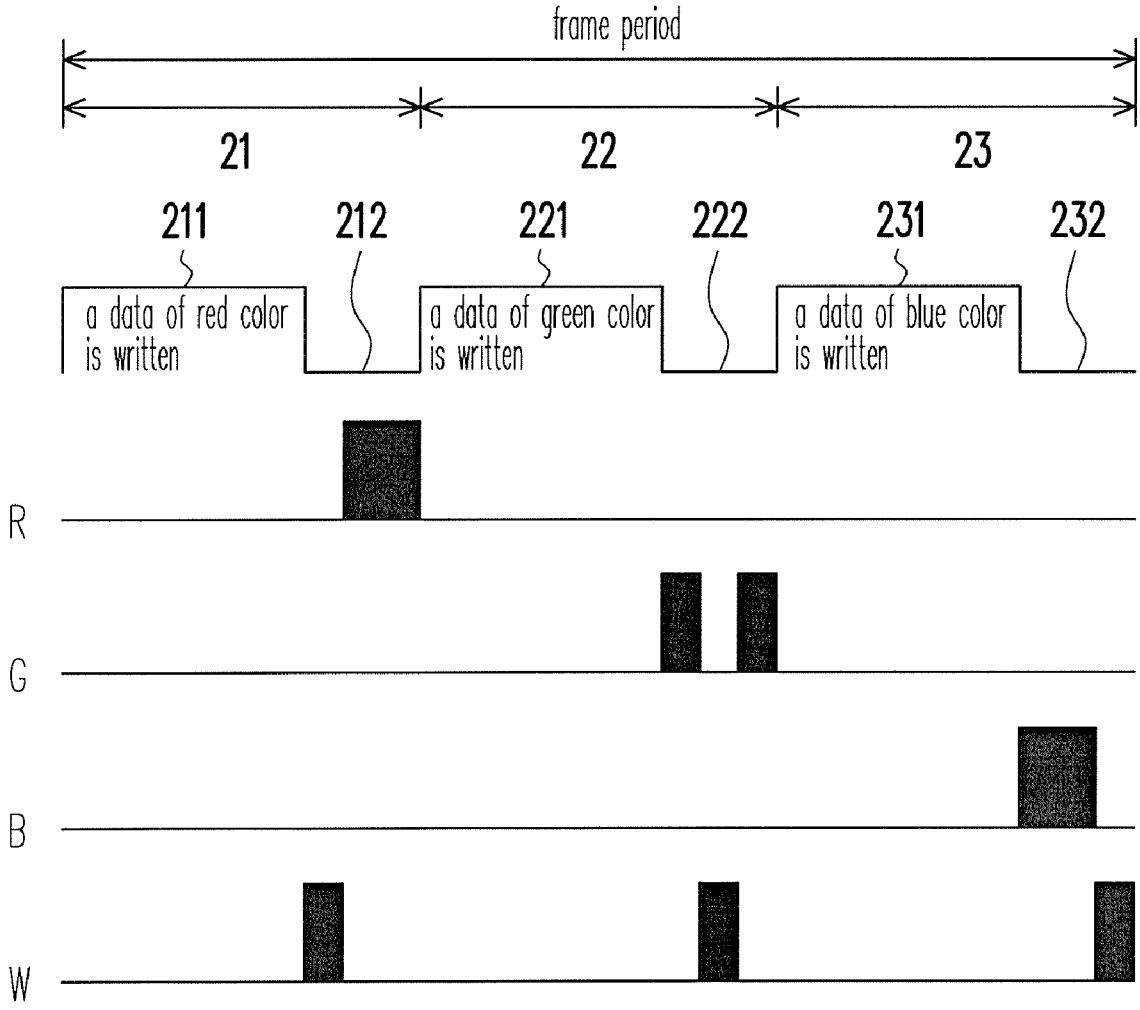
FIG. 3 is a timing diagram of the method for driving a color-sequential display according to the second embodiment of the present invention.

FIG. 3 is a timing diagram of the method for driving a color-sequential display according to the second embodiment of the present invention. Referring to FIG. 3, the second embodiment exemplarily targets an application of an LCD panel adopting the color sequential method as well. The technology of FIG. 3 is similar to that of FIG. 2 except that the embodiment of FIG. 3 further adopts a white backlight (W) in addition to the backlights R, G and B. Referring to FIGS. 2 and 3, instead of simultaneously turning on the red backlight, the green backlight and the blue backlight in FIG. 2, during the same duration in FIG. 2 where the above-mentioned three color backlights are turned on, the white backlight is turned on in FIG. 3. The operation principle herein is the same, thus it is omitted to describe.

Figure 4:
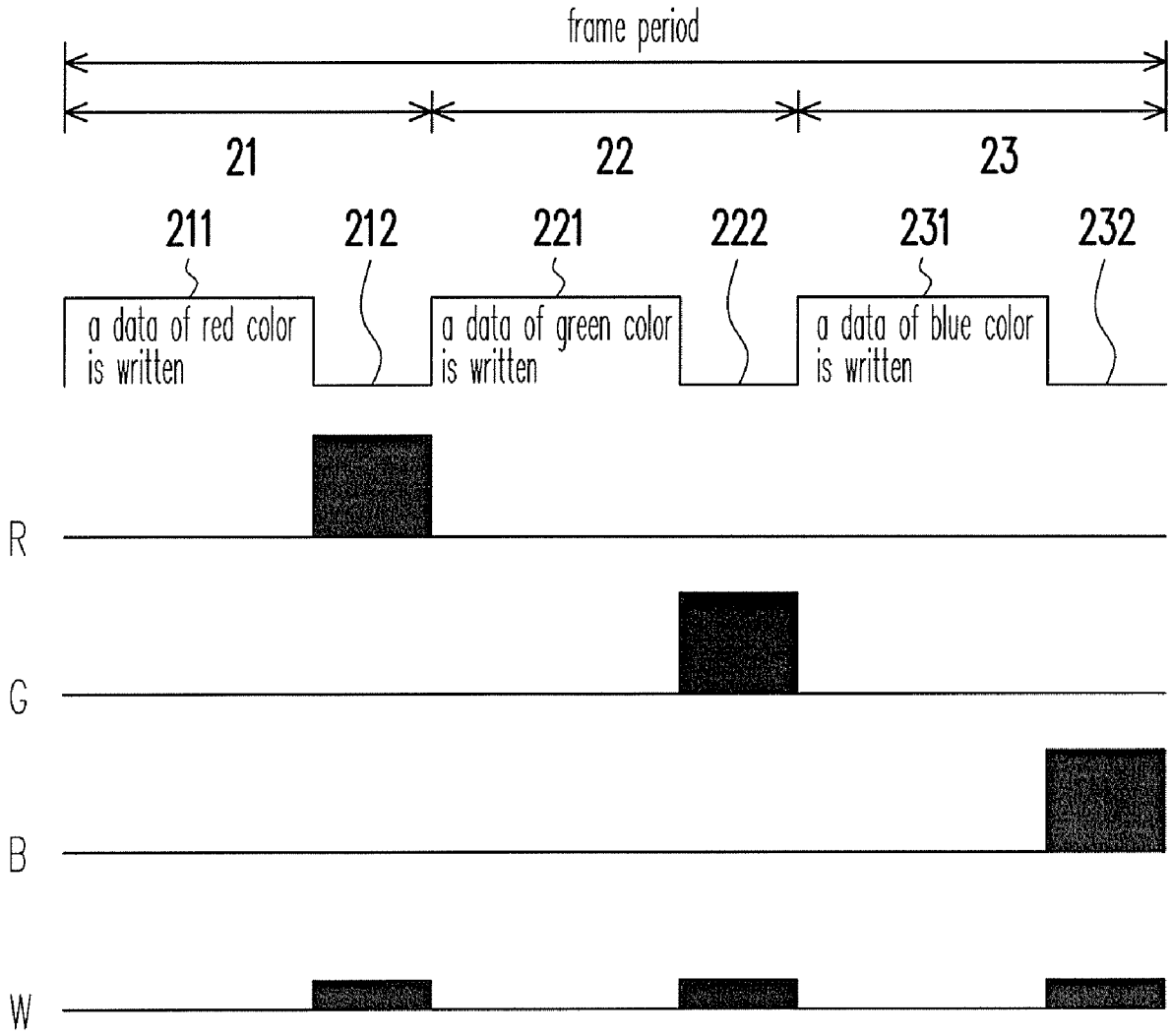
FIG. 4 is a timing diagram of the method for driving a color-sequential display according to the third embodiment of the present invention.

FIG. 4 is a timing diagram of the method for driving a color-sequential display according to the third embodiment of the present invention. Referring to FIG. 4, the embodiment of FIG. 4 has a difference from the above-described two embodiments that the white light is added for a predetermined time length shorter than the backlight turned-on period in the above-described two embodiments, but the white light emitted by the white backlight in FIG. 4 is added during the entire backlight turned-on period, and the brightness of the adopted white backlight in the third embodiment is weaker than that of the previous two embodiments. The third embodiment functions also to reduce the color break-up phenomenon.

Figure 5:
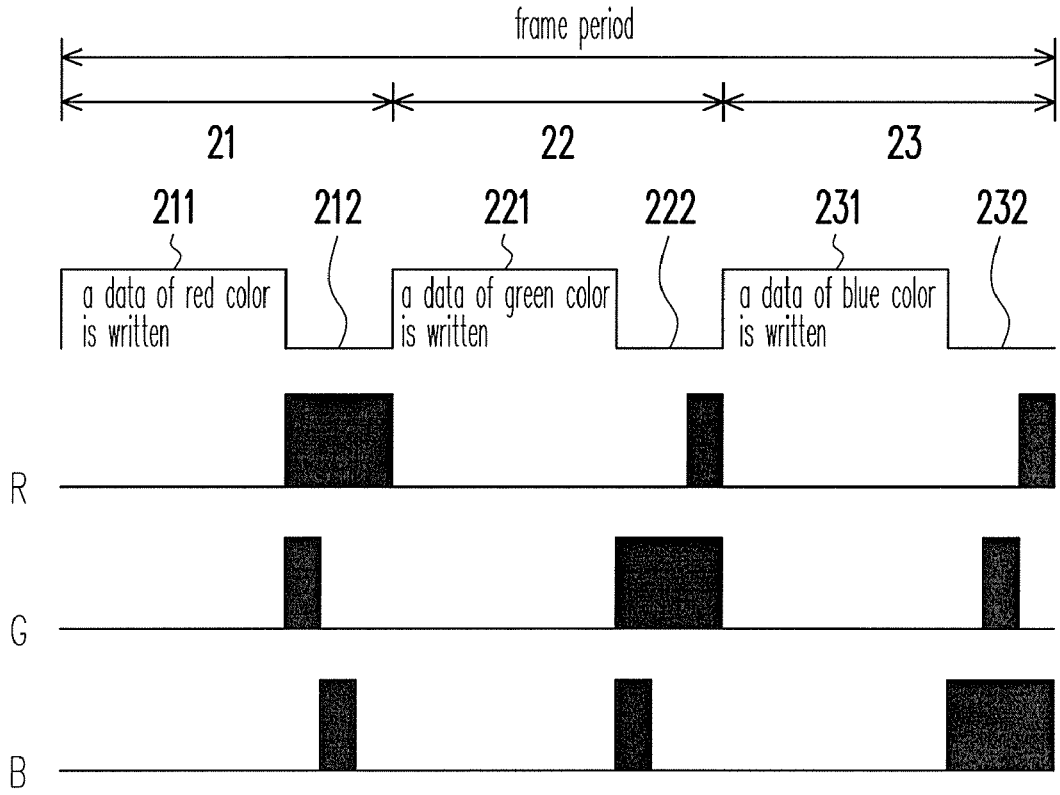
FIG. 5 is a timing diagram of the method for driving a color-sequential display according to the fourth embodiment of the present invention.

FIG. 5 is a timing diagram of the method for driving a color-sequential display according to the fourth embodiment of the present invention. Referring to FIG. 5, although the fourth embodiment adopts the same red backlight, green backlight and blue backlight as the first embodiment, but it has a different timing from the previous embodiments. Within the data-writing period 211 of the first sub-frame period 21, a data of red color is transmitted to each pixel by a source driver. Within the backlight turned-on period 212 of the first sub-frame period 21, a red backlight and a green backlight are turned on for a predetermined time length; then, only the red backlight keeps turned on and the green backlight is turned off, and a blue backlight is turned on; finally, the red backlight keeps turned on and the blue backlight is turned off.

Similarly, within the data-writing period 221 of the second sub-frame period 22, a data of green color is transmitted to each pixel by the source driver. Within the backlight turned-on period 222 of the second sub-frame period 22, the green backlight and the blue backlight are turned on for a predetermined time length; then, only the green backlight keeps turned on and the blue backlight is turned off; finally, the red backlight is turned on. Further, within the data-writing period 231 of the third sub-frame period 23, a data of blue color is transmitted to each pixel by the source driver. Within the backlight turned-on period 232 of the third sub-frame period 23, the blue backlight is turned on for a predetermined time length first; then, the green backlight is turned on; after a final predetermined time length, the green backlight is turned off and the blue backlight keeps turned on, and the red backlight is turned on.

It seems that the fourth embodiment takes an operation principle different from that of the first, second and third embodiments, but in fact, the fourth embodiment is based on the same principle where a white light is added during displaying a data in a specific color (R, G or B). However, the added white light is blended on time domain. In other words, three color backlights are sequentially turned on so as to obtain a white light visual effect. In this way, the fourth embodiment achieves the same effect as the previous three embodiments as well.

Figure 6:
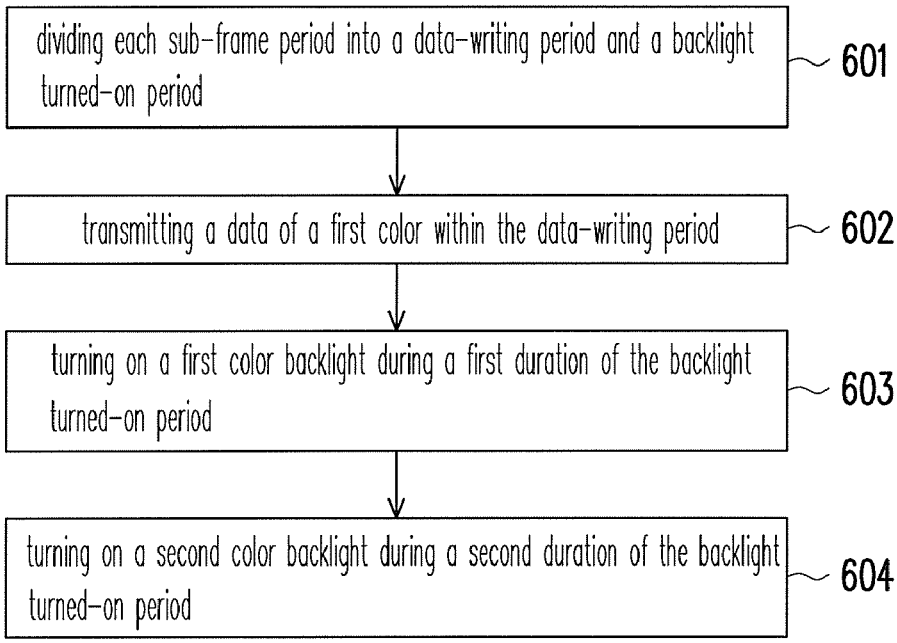
FIG. 6 is a flowchart of the method for driving a color-sequential display according to the present invention.

Based on the above-described four embodiments, a flowchart of the method for driving a color-sequential display can be extracted. FIG. 6 is a flowchart of the method for driving a color-sequential display according to the present invention. Referring to FIG. 6, in step 601, each sub-frame period is divided into a data-writing period and a backlight turned-on period. In step 602, a data of a first color is transmitted within the data-writing period. In step 603, a first color backlight is turned on during a first duration of the backlight turned-on period. In step 604, a second color backlight is turned on during a second duration of the backlight turned-on period.

In the above-described embodiments, the sequence between the first duration and the second duration is not specially limited, and the embodiments do not define the first duration and the second duration are overlapped by each other or not. In terms of the first sub-frame period 21 of the first embodiment, the first color herein is the red color and the second color is green color or the blue color, and the second duration is just the preset time length to display green color and the blue color and the first duration is just the entire backlight-turned on period to display the red color. In terms of the first sub-frame period 21 of the third embodiment, the first color is the red color, the second color is the white color, and the first duration and the second duration are overlapped by each other. In short, the present invention is not limit thereto in this regard.

In summary, since during keeping a backlight in a color corresponding to the color of the displayed data turned on, a plurality of other backlight in different colors from the color of the displayed data is added and turned on; therefore, the present invention can reduce the color break-up phenomenon with dynamic images.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving a color-sequential display, comprising:

dividing each sub-frame period into a data-writing period and a backlight turned-on period;

transmitting a data of a first color within the data-writing period;

turning on a first color backlight during a first duration of the backlight turned-on period; and turning on a second color backlight during a second duration of the backlight turned-on period, wherein every three sub-frame periods are defined as a frame period, wherein:

a data of red color is transmitted within the data-writing period of a first sub-frame period;

a white backlight is turned on during the second duration of the backlight turned-on period; and a red backlight is turned on during the first duration of the backlight turned on period;

wherein in the first sub-frame period, the second duration is prior to the first duration.

2. The method for driving a color-sequential display according to claim 1, wherein:

a data of green color is transmitted within the data-writing period of a second sub-frame period;

the white backlight is turned on during the second duration of the backlight turned-on period; and a green backlight is turned on during the first duration of the backlight turned-on period, wherein in the second sub-frame period, the second duration is arranged at the middle of the first duration.

3. The method for driving a color-sequential display according to claim 1, wherein:

a data of blue color is transmitted within the data-writing period of a third sub-frame period;

the white backlight is turned on during the second duration of the backlight turned-on period; and a blue backlight is turned on during the first duration of the backlight turned-on period;

wherein in the third sub-frame period, the second duration is after the first duration.

4. A method for driving a color-sequential display, comprising:

dividing each sub-frame period into a data-writing period and a backlight turned-on period;

transmitting a data of a first color within the data-writing period;

turning on a first color backlight during a first duration of the backlight turned-on period; and turning on a second color backlight during a second duration of the backlight turned-on period, wherein every three sub-frame periods are defined as a frame period, and wherein:

a data of red color is transmitted within the data-writing period of a first sub-frame period;

a green backlight and a red backlight are turned on during the second duration of the backlight turned-on period;

a blue backlight and the red backlight are turned on during a third duration of the backlight turned-on period; and the red backlight is turned on during the first duration of the backlight turned-on period;

wherein in the first sub-frame period, the second duration is prior to both the first duration and the third duration, and the third duration is prior to the first duration.

5. The method for driving a color-sequential display according to claim 4, wherein:

a data of green color is transmitted within the data-writing period of a second sub-frame period;

the green backlight and the blue backlight are turned on during the second duration of the backlight turned-on period;

a red backlight and the green backlight are turned on during the third duration of the backlight turned-on period; and the green backlight is turned on during the first duration of the backlight turned-on period;

wherein in the second sub-frame period, the second duration is prior to both the first duration and the third duration, and the third duration is after the first duration.

6. The method for driving a color-sequential display according to claim 4, wherein:

a data of blue color is transmitted within the data-writing period of a third sub-frame period;

the green backlight and the blue backlight are turned on during the second duration of the backlight turned-on period;

the blue backlight and a red backlight are turned on during the third duration of the backlight turned-on period; and the blue backlight is turned on during the first duration of the backlight turned-on period;

wherein in the third sub-frame period, the second duration and the third duration are after the first duration, and the third duration is after the second duration.

7. A method for driving a color-sequential display, comprising:

dividing each sub-frame period into a data-writing period and a backlight turned-on period;

transmitting a data of a first color within the data-writing period;

turning on a first color backlight during a first duration of the backlight turned-on period; and turning on a second color backlight during a second duration of the backlight turned-on period, wherein every three sub-frame periods are defined as a frame period, and wherein:

a data of red color is transmitted within the data-writing period of a first sub-frame period;

a red backlight, a green backlight and a blue backlight are turned on during the second duration of the backlight turned-on period; and the red backlight is turned on during the first duration of the backlight turned-on period;

wherein in the first sub-frame period, the second duration is prior to the first duration.

8. The method for driving a color-sequential display according to claim 7, wherein:

a data of green color is transmitted within the data-writing period of a second sub-frame period;

the red backlight, the green backlight and the blue backlight are turned on during the second duration of the backlight turned-on period; and the green backlight is turned on during the first duration of the backlight turned-on period;

wherein in the second sub-frame period, the second duration is arranged at the middle of the first duration.

9. The method for driving a color-sequential display according to claim 7, wherein:

a data of blue color is transmitted within the data-writing period of a third sub-frame period;

the red backlight, the green backlight and the blue backlight are turned on during the second duration of the backlight turned-on period; and the blue backlight is turned on during the first duration of the backlight turned-on period;

wherein in the third sub-frame period, the second duration is after the first duration.

10. A method for driving a color-sequential display, comprising:

dividing each sub-frame period into a data-writing period and a backlight turned-on period;

transmitting a data of a first color within the data-writing period;

turning on a first color backlight during a first duration of the backlight turned-on period; and turning on a second color backlight during a second duration of the backlight turned-on period, wherein every three sub-frame periods are defined as a frame period, and wherein:

a data of red color is transmitted within the data-writing period of a first sub-frame period;

a white backlight is turned on during the second duration of the backlight turned-on period; and a red backlight is turned on during the first duration of the backlight turned-on period;

wherein in the first sub-frame period, the second duration and the first duration are overlapped by each other, and the brightness of the white backlight is smaller than the brightness of the red backlight.

11. The method for driving a color-sequential display according to claim 10, wherein:

a data of green color is transmitted within the data-writing period of a second sub-frame period;

the white backlight is turned on during the second duration of the backlight turned-on period; and a green backlight is turned on during the first duration of the backlight turned-on period;

wherein in the first sub-frame period, the second duration and the first duration are overlapped by each other, and the brightness of the white backlight is smaller than the brightness of the green backlight.

12. The method for driving a color-sequential display according to claim 10, wherein:

a data of blue color is transmitted within the data-writing period of a third sub-frame period;

the white backlight is turned on during the second duration of the backlight turned-on period; and a blue backlight is turned on during the first duration of the backlight turned-on period;

wherein in the first sub-frame period, the second duration and the first duration are overlapped by each other, and the brightness of the white backlight is smaller than the brightness of the blue backlight.

* * * * *